United States Patent [19]

Healy et al.

[11] Patent Number: 4,728,040

[45] Date of Patent: Mar. 1, 1988

[54] INTERCHANGEABLY CONNECTABLE SPRINKLER DEFLECTOR AND HOSE

[75] Inventors: Mark Healy, Orlando; Fred Elliott, Winter Garden; William McFadden; Thomas Senninger, both of Orlando, all of Fla.

[73] Assignee: Senninger Irrigation, Inc., Orlando, Fla.

[21] Appl. No.: 426,723

[22] Filed: Sep. 29, 1982

[51] Int. Cl.[4] ..... B05B 1/26; B05B 15/06

[52] U.S. Cl. ..... 239/390; 239/524; 239/734; 285/12

[58] Field of Search ..... 239/390, 397, 289, 498, 239/523, 505, 510, 514, 524, 734; 285/192, 12, 6, 208, 209, DIG. 22

[56] References Cited

U.S. PATENT DOCUMENTS

| | | | |
|---|---|---|---|
| 1,165,838 | 12/1915 | Brill | 285/DIG. 22 |
| 2,490,363 | 12/1949 | Lang | 285/DIG. 22 |
| 4,676,438 | 6/1987 | Sesser | 239/722 |

FOREIGN PATENT DOCUMENTS

| | | | |
|---|---|---|---|
| 160428 | 5/1905 | Fed. Rep. of Germany | 239/498 |

*Primary Examiner*—Andres Kashnikow
*Assistant Examiner*—Kevin Patrick Weldon
*Attorney, Agent, or Firm*—William M. Hobby, III

[57] ABSTRACT

An irrigation spray nozzle apparatus has a base member for attachment to a water line, which has a passageway therethrough. A nozzle is attached to the base member to control water flow and to direct water from the outlet of the passageway through the base towards a water deflector pad removably attached to a water deflector pad support to spray water passing from the nozzle. At least one arm is attached to the base and to the water deflector pad in position in line with the outlet of the nozzle. The water deflector pad can be removed and a hose attached through a passageway through the pad support or to an extension on the pad support itself, to convert the spray nozzle to an irrigation hose discharge device.

10 Claims, 7 Drawing Figures

FIG. 1
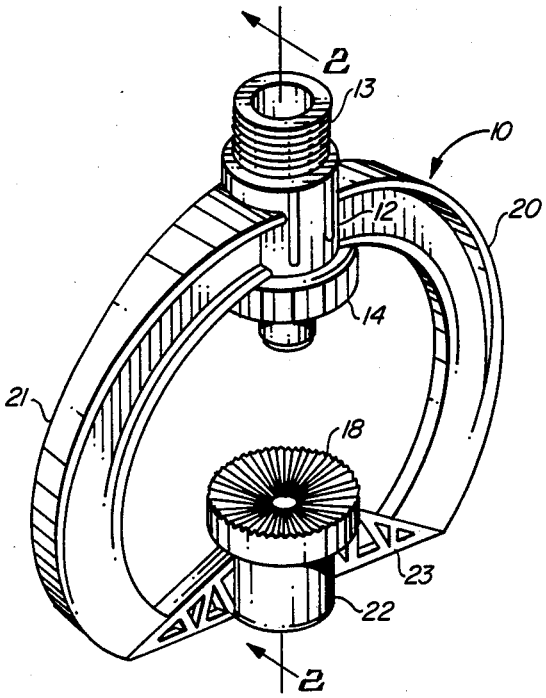
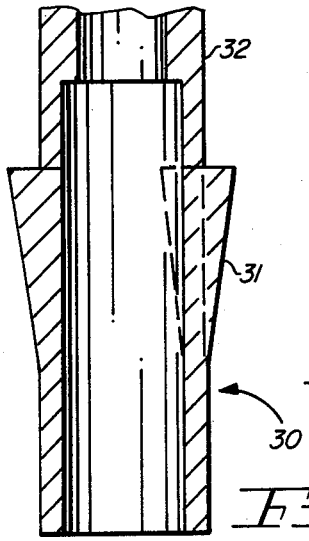
FIG. 5
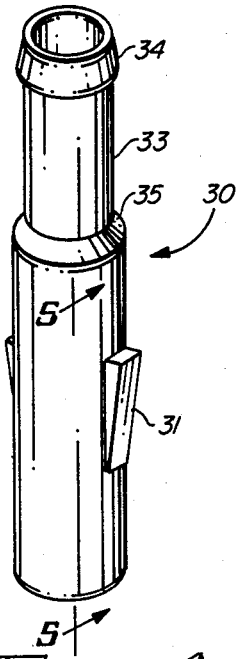
FIG. 4
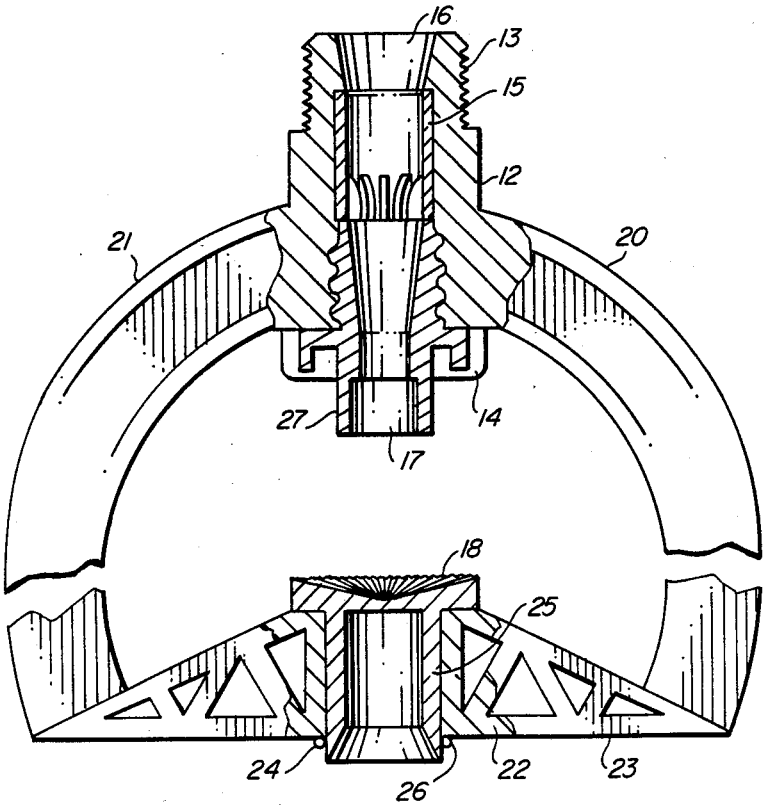
FIG. 2
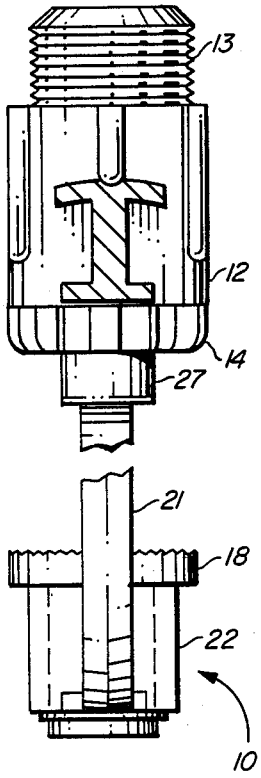
FIG. 3

INTERCHANGEABLY CONNECTABLE SPRINKLER DEFLECTOR AND HOSE

BACKGROUND OF THE INVENTION

The present invention relates to sprinkler heads and especially to sprinkler heads which can be readily converted to an irrigation discharge hose.

In the past, a great variety of sprinklers have been utilized for watering or irrigation purposes, and typically, sprinkler heads are attached to water lines which may be under the earth or above the earth for directing the water from water lines in a predetermined pattern to sprinkle an area of the earth's surface. One type of irrigation equipment that is becoming common is a central irrigation pipe connected to a central well and pump, which is mounted on wheels and extends out across a field. The wheels may have an electric motor or other means for moving the wheels to move the irrigation pipe, which is then rotated around a segment of a farm to irrigate a large area. The irrigation pipe typically would have sprinkler heads of some type attached to the top thereof for spraying the water from the irrigation pipe as it moves over a circular area. Such irrigation pipes have used various types of sprinkler heads and recently have attached hoses to the bottom thereof for flooding the furrows in the field for irrigation purposes during part of the year; and then replacing a portion of the hose with a sprinkler head for spraying the fields when the plants reach a predetermined size. Since the central irrigation pipe has a large number of hoses or sprinkler heads along its length, it becomes time consuming to replace a portion of each hose with a sprinkler head and the present invention is directed towards a sprinkler head which can be readily converted to an irrigation hose discharge outlet by simply removing a water deflector pad covering a passageway and connecting the hose to or through the passageway to the nozzle of the sprinkler head.

SUMMARY OF THE INVENTION

A sprinkler head or spray nozzle is provided which has a base member for attaching to a water line with a passageway therethrough for the passage of water through the base. A nozzle is attached to the base member to direct water from the outlet of the passageway therethrough onto a water deflector pad which disperses the water into a spray pattern. The water deflector pad is removably attached to a water deflector pad support held by one or more arms attached to the base member. The water deflector pad covers a passageway through the water deflector pad support so that removal of the water deflector pad allows a removably attachable hose to be attached through the passageway of the pad support to the sprinkler head nozzle, so that the sprinkler head is readily converted to an irrigation discharge hose.

One embodiment provides a hose connector attached to a hose which slides through the passageway through the pad support, over a hose connecting portion of the nozzle and is locked in place with clips; while a second embodiment slides the end of a piece of hose directly through the passageway of the pad support over the hose connector extension of the nozzle. A third embodiment slides the end of a piece of hose over a hose connector which is an extension of the pad support.

BRIEF DESCRIPTION OF THE DRAWINGS

Other objects, features and advantages of the present invention will be apparent from the written description and the drawings, in which:

FIG. 1 is a perspective view of a sprinkler head in accordance with the present invention;

FIG. 2 is a sectional view taken on the line 2—2 of FIG. 1;

FIG. 3 is a partial end elevation of a sprinkler head of FIGS. 1 and 2;

FIG. 4 is a perspective view of a hose attaching member;

FIG. 5 is a sectional view taken on the line 5—5 of FIG. 4;

DESCRIPTION OF THE PREFERRED EMBODIMENT

Figure 6:
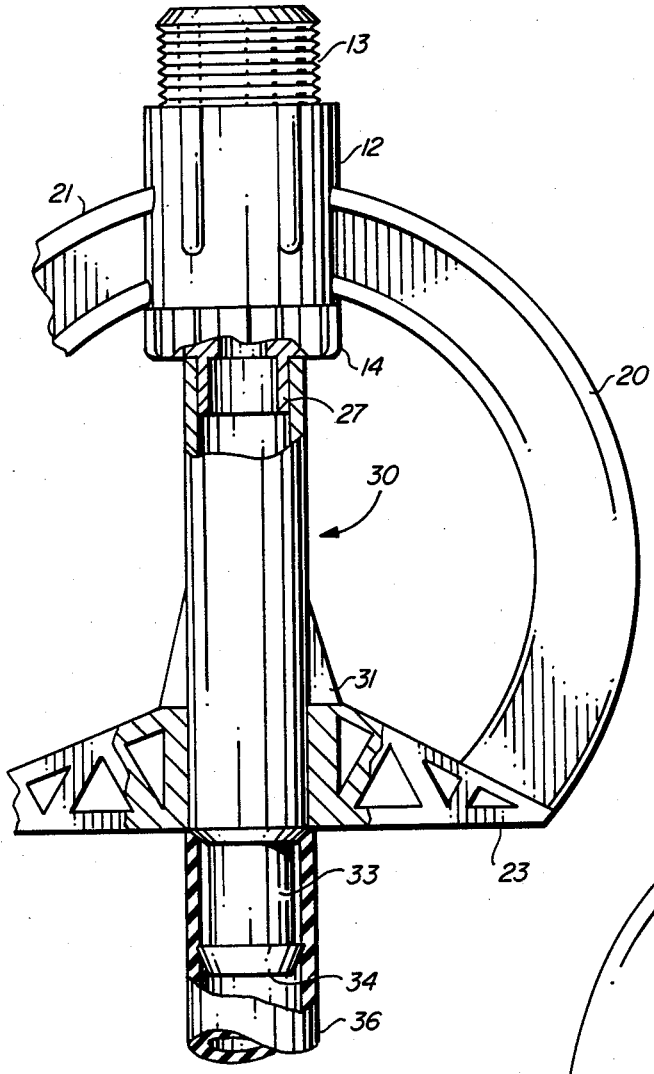
FIG. 6 is a partial side elevation with portions cutaway of the sprinkler head of FIGS. 1 through 3 having a hose connected thereto.

Referring to FIGS. 1 through 6 of the drawings, a sprinkler head 10 has a base portion 12 having a threaded portion 13 for threading to a water line or to a water pipe and has a nozzle 14 removably attached to the base portion 12. The base portion also has a water straightening vane 15 removably held in place by the nozzle 14. The base 12 has a passageway 16 therethrough allowing water to pass through the base 12 through the vane 16 and through the nozzle 14 and out the nozzle opening 17 aimed directly at a removably mounted water deflection pad 18 which deflects and sprays the water over a 360° arc. The sprinkler 10 has a pair of arms 20 and 21 arcuately mounted from the base 12 to a water deflection support portion 22 and includes a pair of trust supports 23. The water deflection pad support portion 22 has a passageway 24 therethrough directly in line with the nozzle 14 outlet 17 and is used to mount the pad 18 thereto with a cylindrical base 25 extending from the face of the pad 18. The cylindrical base 25 has a pair of tits 26 thereon for holding on pad 25 therein; which allows the pad 18 to be quickly removed by simply pulling it out of the passageway 24. The nozzle 14 has an extension 27 which advantageously allows a hose or hose connecting member to be slid thereover, as shown in FIGS. 6 and 7.

A sprinkler 10 can be readily converted from a sprinkler or spray head to a hose discharge irrigation outlet by removing the pad 18 leaving an open passageway 24 facing the nozzle outlet 17. A hose connecting member 30 has a pair of molded in click stops 31 mounted therein with an open space around three sides, which allows the click stop 31 to be pressed in even with the cylindrical walls 32 of the connector 30. The connector 30 has a narrowed hose connecting portion 33 having an annular lip 34 on the end thereof and thereby forming a hose stop ledge 35 so that a hose can slip over the lip 34 and abut against the ledge 35 and be left permanently attached thereto. In this condition, the hose 36 can be attached to the nozzle 14 by sliding the connector 30 through the passageway 24 of the deflection pad support 22 until the end of the hose connector 30 slides over the extending portion 27 of the nozzle 14 as shown in FIG. 6, and until the click stops 31 have extended and abut against the surface 37 of the truss arms 23.

It can be seen at this point that a rapid conversion from an ordinary sprinkler head to a hose discharge irrigation system can be accomplished by simply removing the pad 18 and sliding the hose connector 30 with the hose 36 attached thereto through the passageway 24 until it locks in place. The sprinkler heads can be reconverted by pressing the click stops in and sliding a hose connector member 30 back through the passageway 24 and replacing the water deflection pad 18.

Figure 7:
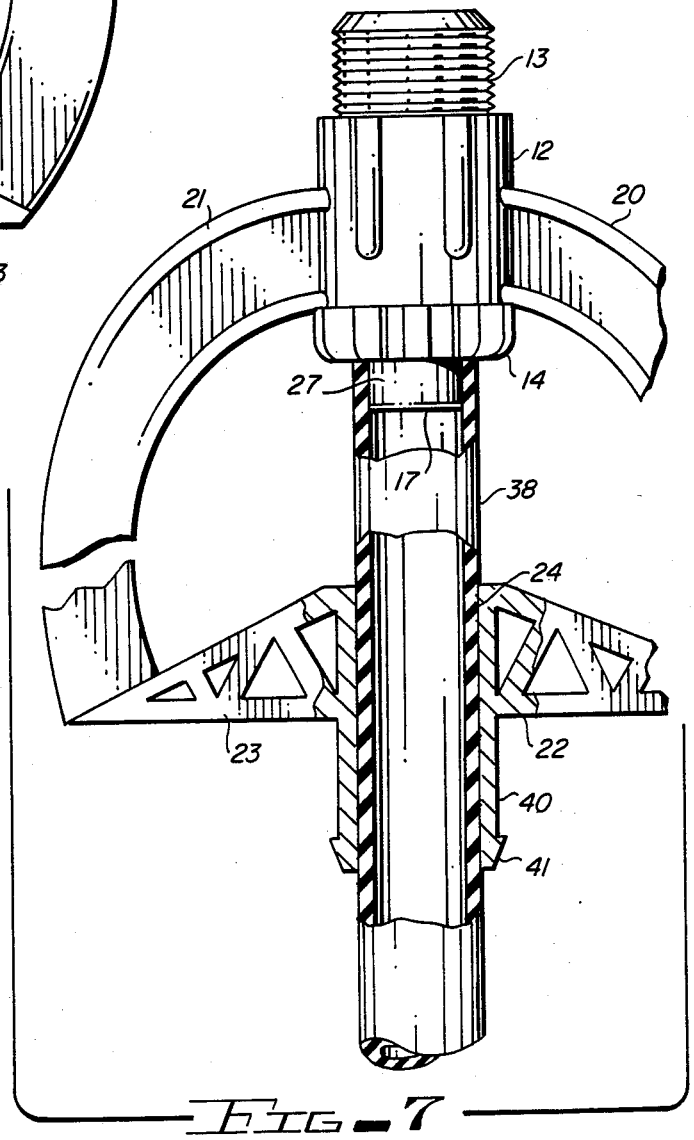
FIG. 7 is a partial side elevation with portions removed of an alternate embodiment of a sprinkler head in accordance with the present invention.

FIG. 7 shows an alternate embodiment in which the self locking connector member 30 is not used and a hose 38 is passed directly through the passageway 24 of the pad supporting portion 22 and slides directly over the hose connecting extension 27 of the nozzle 14. A clamp can be used to anchor the hose 38 to the extension 27, but it has been found that a properly sized extension 27 generally does not need a clamp and can be pressure fitted over extension 27. In this embodiment, an added hose extension 40 is illustrated having an annular lip 41 which will allow a hose to be attached thereover, if desired, so that the outlet 17 of the nozzle extension 27 is directed to the open passageway 24 across an empty space and into a hose, which might be attached to the hose connecting extension 40.

It will, of course, be clear that many variations of the present invention are contemplated, such as the nozzles 14 being color coded for different sizes and being readily replaceable, and similarly, the pads 18 may be replaced. Accordingly, the present invention is not to be construed as limited to the forms shown, which are to be considered illustrative rather than restrictive.

We claim:

1. A sprinkler head apparatus comprising in combination:

a base member for attachment to a water line having a passageway therethrough;

a nozzle attached to said base member to control the water flow and to direct water from the outlet of said passageway through said base, said nozzle having an extension extending therefrom adapted to couple to a water hose;

a water deflector pad support;

at least one arm attached to said base member and to said water deflector pad support to position said pad support in line with said nozzle;

a water deflector pad removably attached over a passageway through said water deflector pad support; and means to removably attach a water hose to said sprinkler head for receiving the output of said nozzle when said water deflector pad is removed from over the passageway, whereby the sprinkler head can be coverted to an irrigation hose discharge device.

2. A sprinkler head apparatus in accordance with claim 1, in which said means to removably attach a hose to said sprinkler head includes a hose connector member having a hose connector portion on one end thereof and shaped to engage said nozzle extension on the other end thereof.

3. A sprinkler head apparatus in accordance with claim 2, in which said hose connector has at least one clip for supporting the hose connector portion through said water deflector pad support passageway against one edge of said support pad.

4. A sprinkler head apparatus in accordance with claim 3, in which said hose connector portion has a pair of biased clips which extend out from said hose connector portion adjacent the edge of said water deflector pad support to prevent said hose connector member from slipping through said passageway in said water deflector pad support.

5. A sprinkler head apparatus in accordance with claim 4, in which said spring biased clips can be compressed into the side of said hose connector member to allow the removal of said hose connector member through said water reflector pad support passageway.

6. A sprinkler head apparatus in accordance with claim 5, in which said hose connector member has an annular lip on one end thereof for attaching a hose thereover.

7. A sprinkler head apparatus in accordance with claim 6, in which said water deflector pad has a base thereon shaped to fit through said water deflector pad support passageway and said base has at least one tit formed thereon to hold said water deflector pad base to said water deflector pad support.

8. A sprinkler head apparatus in accordance with claim 1, in which said means to movably attach a hose to said sprinkler head includes a hose connectors extension extending from said water deflector pad support for attaching a hose thereto.

9. A sprinkler head apparatus in accordance with claim 8, in which said hose connector extension has an annular lip thereon for attaching a hose thereover.

10. A sprinkler head apparatus in accordance with claim 1, in which said nozzle is removably attached to said base member and has a hose connector extention extending therefrom, whereby said nozzle can be replaced for different size hose connectors.

* * * * *